US007877029B2

(12) United States Patent
Sako et al.

(10) Patent No.: US 7,877,029 B2
(45) Date of Patent: Jan. 25, 2011

(54) IMAGE FORMING APPARATUS AND FOG CONTROL METHOD

(75) Inventors: Mineyuki Sako, Toyokawa (JP); Yutaka Miyasaka, Machida (JP); Nobuyasu Tamura, Hachioji (JP); Kazutoshi Kobayashi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1008 days.

(21) Appl. No.: 11/507,616

(22) Filed: Aug. 22, 2006

(65) Prior Publication Data

US 2007/0104501 A1 May 10, 2007

(30) Foreign Application Priority Data

Nov. 8, 2005 (JP) ..... 2005-323413

(51) Int. Cl.
*G03G 15/00* (2006.01)

(52) U.S. Cl. ..... 399/49; 399/46; 399/27; 356/446

(58) Field of Classification Search ..... 399/49, 399/50, 72, 55

See application file for complete search history.

(56) References Cited

U.S. PATENT DOCUMENTS 5,652,952 A * 7/1997 Katsuhara ..... 399/72
7,292,798 B2 * 11/2007 Furukawa et al. ..... 399/49
2002/0051142 A1 * 5/2002 Ogata et al. ..... 358/1.8
2005/0083530 A1 * 4/2005 Ogihara et al. ..... 356/446

FOREIGN PATENT DOCUMENTS

| | | |
|---|---|---|
| JP | 5-224512 | 9/1993 |
| JP | 07-056424 | 3/1995 |
| JP | 2003-015484 | 1/2003 |
| JP | 2003-270875 | 9/2003 |
| JP | 2005-148355 | 6/2005 |
| JP | 2005-148470 | 6/2005 |

OTHER PUBLICATIONS

Japanese Office Action dated Oct. 28, 2008.

* cited by examiner

*Primary Examiner*—David M Gray
*Assistant Examiner*—Roy Yi
(74) *Attorney, Agent, or Firm*—Finnegan, Henderson, Farabow, Garrett & Dunner, L.L.P.

(57) ABSTRACT

An image forming apparatus includes a fog controller to control a fogging level of a toner image carrier by adjusting a fog control parameter on the basis of the fogging level detected by a fogging level detection section and the target fogging level stored in a memory section. While varying a value of the fog control parameter, the fog controller makes a detection pattern forming section to form a series of detection patterns between toner images for each page on the toner image carrier, makes the fogging level detection section to detect each of fogging levels of the series of detection patterns, determines a target fog control parameter value on the basis of each fogging level of the series of detection patterns detected and the target fogging level stored, and adjusts the fog control parameter on the basis of the target fog control parameter value.

16 Claims, 9 Drawing Sheets

IMAGE FORMING APPARATUS AND FOG CONTROL METHOD

This application is based on Japanese Patent Application No. 2005-323413 filed on Nov. 8, 2005, which is incorporated hereinto by reference.

BACKGROUND OF THE INVENTION

The present invention relates to an image forming apparatus and fog control method based on electrophotographic technology.

In an image forming apparatus based on electrophotographic technology, a developer bearing member for bearing the developer (toner in the case of a one-component development, and toner and carrier in the case of a two-component development) is moved relative to the photoreceptor with an electrostatic latent image formed thereon, whereby the electrostatic latent image on the photoreceptor is developed. In this case, to ensure that the background fog (toner adhered to the background where toner should not adhere) does not occur, a potential difference is provided between the surface potential of the photoreceptor background portion and the bias potential of the developer bearing member (hereinafter referred to simply as "development bias" in some cases).

However, even if a proper potential difference is provided between the surface potential of the photoreceptor background portion and the bias potential of the developer bearing member, the characteristics of the developer such as the amount of charged toner and quantity of the developer are changed by a change with the passage of time due to large number of printing, environmental condition change and long period of time to be left, with the result that a background fog (hereinafter referred to simply as "fog" in some cases) occurs.

One of the efforts to solve this problem is disclosed in the Patent Document 1 (Japanese Patent Application Publication No. 05-224512) wherein toner density of toner fog is detected by a toner sensor while the development bias is changed before image formation, and the characteristic curve of toner density with respect to development bias is obtained. If the development bias capable of outputting the toner density when toner is no adhered is higher than a reference level, copying operation is carried out by increasing development bias by a predetermined amount, thereby solving the problem caused by a rise in fogging level.

Further, the Patent Document 2 (Japanese Patent Application Publication No. 2003-270875) discloses the technique wherein the amount of fog is detected by a fogging toner detecting sensor before and during image formation, and toner fogging preventive operation (preliminary agitation of developer) is performed either during the process of idling before and after image formation, or at the time of turning on the power again subsequent to turning it off.

However, the time to perform the toner fogging preventive operation described in the aforementioned Japanese Patent Application Publication No. 05-224512 and Japanese Patent Application Publication No. 2003-270875 is either during the process of idling before and after image formation, or at the time of turning on the power again subsequent to turning it off. Toner fogging preventive operation is not carried out in the middle of the job. Thus, a variation occurs to the fogging level in a job requiring a long working time. Despite fog deterioration, image formation continues under the same image formation conditions, with the result that the problem of fog deterioration cannot be solved in the prior art.

SUMMARY OF THE INVENTION

The object of the present invention is to solve the aforementioned problems and to provide an image forming apparatus and fog control method capable of minimizing a variation in fogging level and preventing fog deterioration even despite a job requiring a long working time. The aforementioned object can be achieved by either following Structure 1 or 2.

1. An image forming apparatus including: a toner image carrier for carrying a toner image; a detection pattern forming section for forming a detection pattern to detect a fogging level on the aforementioned toner image carrier; a fogging level detection section, arranged opposite to the aforementioned toner image carrier, for detecting a fogging level by detecting the detection pattern formed by the aforementioned detection pattern forming section; a memory section for storing a target fogging level; a fog controller for controlling the fogging level of the aforementioned toner image carrier fogging level by adjusting the fog control parameter, based on the fogging level detection by the aforementioned fogging level detection section and the target fogging level stored in the aforementioned memory section. The aforementioned fog controller contains the steps of: varying the aforementioned fog control parameter value, allowing the aforementioned detection pattern forming section to form a series of detection patterns between toner images for each page carried by the aforementioned toner image carrier; allowing the aforementioned fogging level detection section to detect the fogging level of each of a series of the aforementioned detection patterns; calculating the target fog control parameter value, based on the fogging level of each of a series of the detection patterns having been detected, and the target fogging level stored in the aforementioned memory section; and adjusting the aforementioned fog control parameter, based on the aforementioned target fog control parameter value having been determined.

2. In a fog control method for controlling a fogging level of a toner image carrier by adjusting a fog control parameter, the fog control method includes a target fogging level storing step to store a target fogging level in a memory section, a detection pattern forming step for making a detection patter forming member to form a series of detection patterns between toner images for each page which are carried on the toner image carrier while varying a fog control parameter value, a fogging level detection step for making a fogging level detection section to detect each of the fogging levels of the series of detection patterns, a target fog control parameter value calculating step for calculating a target fog control parameter value on the basis of each of the fogging levels of the series of detection patterns which have been detected and the target fogging level which has been stored in the memory section, and a fog control parameter adjusting step for adjusting the fog control parameter on the basis of the target fog control parameter value which has been determined.

DETAILED DESCRIPTION OF THE PREFERRED EMBODIMENT (Overall Structure and Basic Operation of an Apparatus)

An example of applying the present invention to a tandem type full color image forming apparatus will be taken to explain the best form of embodiment of the present invention, without the present invention being restricted thereto.

Figure 1:
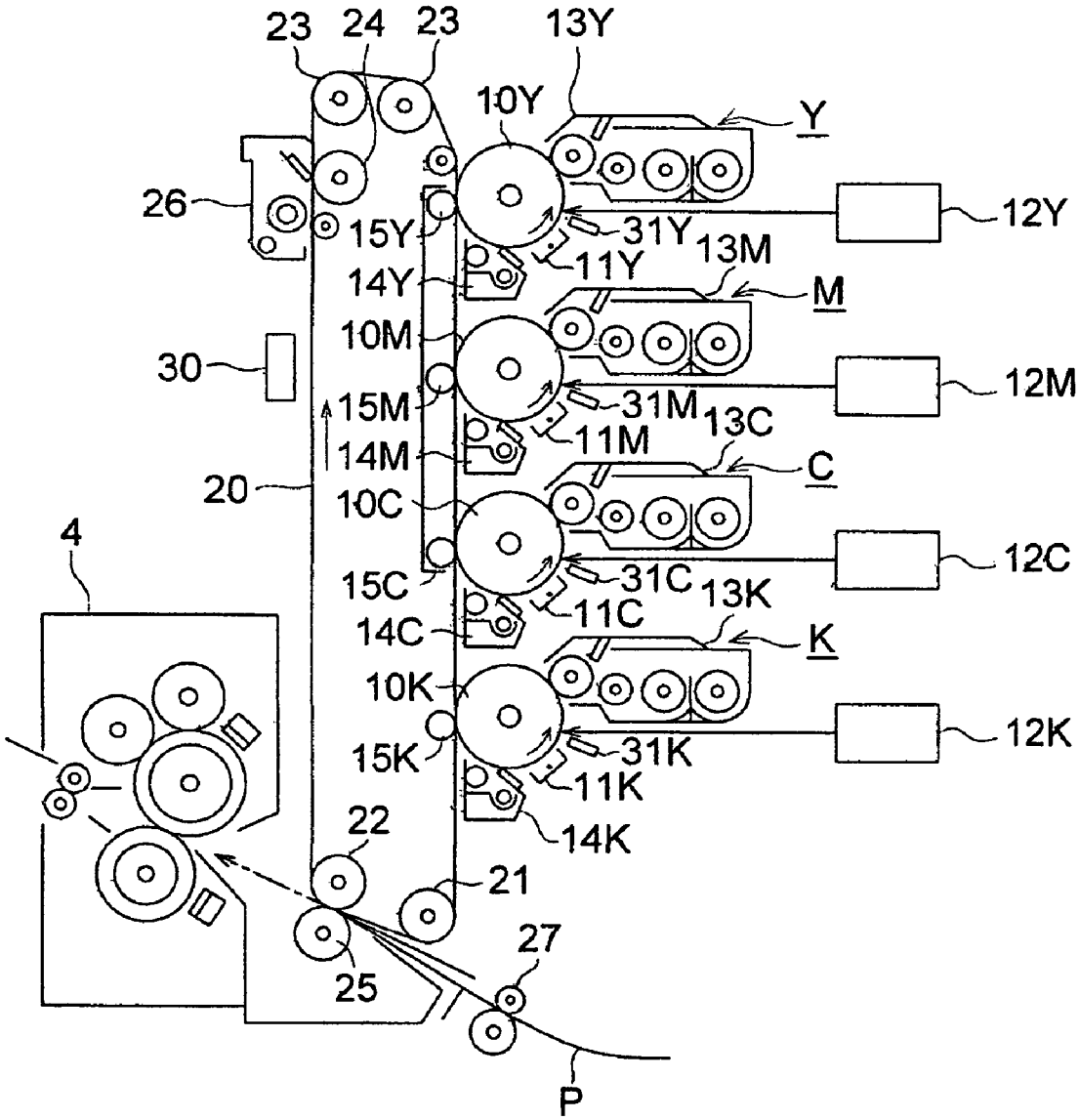
FIG. 1 is a schematic diagram representing an image forming apparatus in the present invention.

FIG. 1 is a schematic diagram representing an image forming apparatus of the present embodiment. The yellow image forming section Y, magenta image forming section M, cyan image forming section C, and black image forming section K are provided in the traveling direction of the intermediate transfer member 20 (toner image carrier). In the yellow image forming section Y, a charging unit 11Y, exposure unit 12Y, developing device 13Y, cleaning device 14Y, surface potential sensor 31Y are arranged around a photoreceptor 10Y in the rotating direction of the photoreceptor 10Y (electrostatic latent image carrier or toner image carrier). An exposure unit 12Y exposes imagewise the surface of the photoreceptor 10Y uniformly charged by the charging unit 11Y so that a latent image is formed. When this latent image has been developed by the developing device 13Y, a yellow toner image is formed on the surface of the photoreceptor 10Y.

A primary transfer roller 15Y as a transfer unit is arranged on the side opposite to the yellow image forming section Y wherein the intermediate transfer member 20 is located in-between. When a predetermined voltage is applied to the primary transfer roller 15Y, a yellow toner image on the photoreceptor 10Y is transferred onto the intermediate transfer member 20. In the meantime, the surface of the photoreceptor 10Y having passed the side opposed to the primary transfer roller 15Y reaches the side opposed to the cleaning device 14Y, and the residual toner without being been transferred by the primary transfer roller 15Y is collected by the cleaning device 14Y.

The magenta image forming section M, cyan image forming section C, and black image forming section K have the same structure as that of the yellow image forming section Y, and will not be described to avoid duplication.

The image forming apparatus of the present embodiment has two modes, namely, a monochromatic mode and a full color mode. In the monochromatic mode, the contact pressure of primary transfer rollers 15Y, 15M and 15C to photoreceptor 10Y, 10M, 10C is released. The portion of the intermediate transfer member 20 opposed to the primary transfer rollers 15Y, 15M and 15C is kept apart by the photoreceptors 10Y, 10M and 10C. The primary transfer rollers 15Y, 15M and 15C are integrated into one unit. The contact pressures of the primary transfer rollers 15Y, 15M and 15C are released synchronically. In the full color mode, contact pressures of all the primary transfer rollers 15Y, 15M, 15C and 15K are applied. The contact pressure of the primary transfer roller 15K is always applied to the photoreceptor 10K whether in the monochromatic or full color mode.

The toner images formed in the image forming sections Y, M, C and K are superimposed on the intermediate transfer member 20, whereby a full color toner image is formed.

The intermediate transfer member 20 is designed in a belt-shaped structure and is entrained about the drive roller 21, earth roller 22, tension roller 23 and driven roller 24. The intermediate transfer member 20 is moved by rotation of the drive roller 21 by a drive motor (not illustrated).

A secondary transfer roller 25 is provided on the side opposite to the earth roller 22 wherein the intermediate transfer member 20 is located in-between. A path is arranged between the intermediate transfer member 20 and secondary transfer roller 25, and the recording medium P having passed through a timing roller 27 runs through this path. When a predetermined voltage is applied to the secondary transfer roller 25, the full color toner image on the intermediate transfer member 20 is transferred to the recording medium P. The fixing unit 4 is used to fix the image on the recording medium P subsequent to transfer.

A cleaning unit 26 is provided on the side opposite the driven roller 24 wherein the intermediate transfer member 20 is located in-between. The remaining toner without having been transferred by the secondary transfer roller 25 is collected.

A fog level detection sensor 30 is arranged opposite the position downstream from the secondary transfer roller 25 of the intermediate transfer member 20 and upstream from the cleaning unit 26. In the fog control to be described later, the detection patterns formed by the image forming sections Y, M, C and K are transferred onto the intermediate transfer member 20 by the primary transfer rollers 15Y, 15M, 15C and 15K. The fog level of detection patterns are detected by the fog level detection sensor 30. When the fog is detected, transfer by the secondary transfer roller 25 is not performed.

(Structure of Image Forming Section and the Process of Image Formation)

Figure 2:
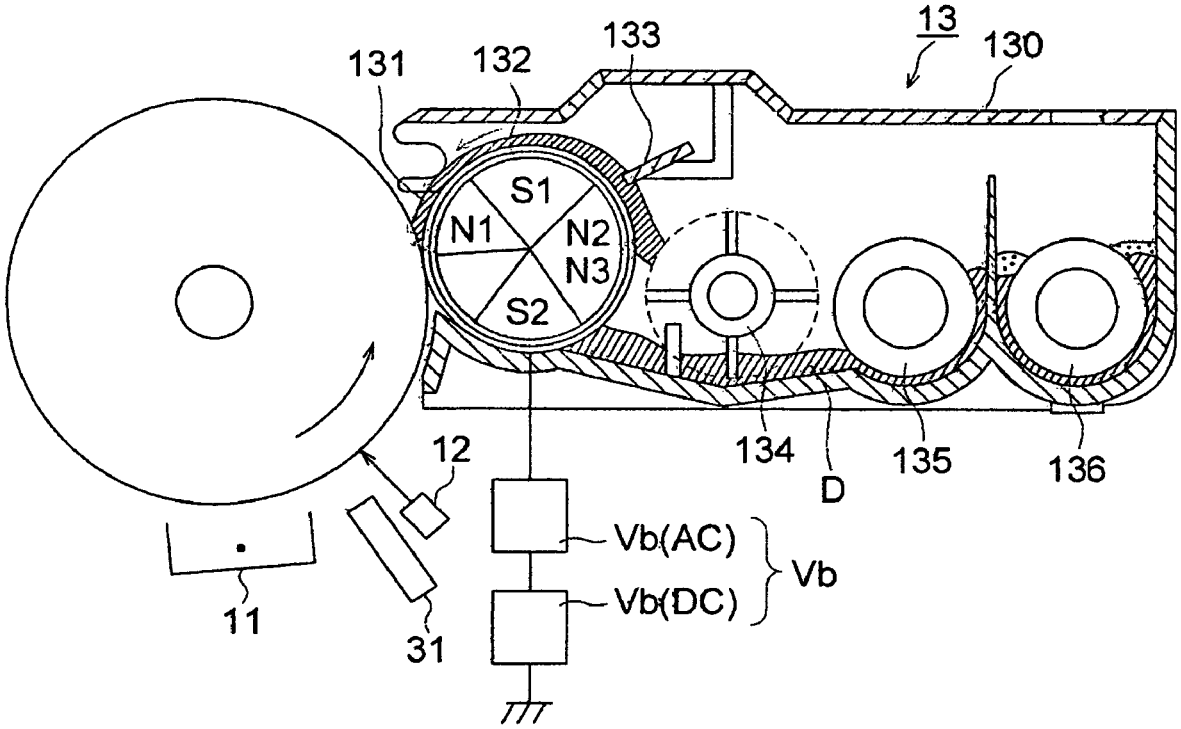
FIG. 2 is a schematic diagram representing an image forming section in the present invention.

FIG. 2 is a detailed drawing of the image forming sections Y, M, C and K of FIG. 1. The image forming sections Y, M, C and K are designed in one and the same structure. Accordingly, the following description will omit the symbols Y, M, C and K at the ends of the components of the image forming sections.

The following describes the present embodiment with an example taken from the case of reversal development by applying a negative development bias using a negatively charged photoreceptor and negatively charged toner. However the present invention is not restricted thereto. The present invention is also applicable to reversal development by applying a positive development bias using a positively charged photoreceptor and positively charged toner. The present invention is applicable to the normal development as well.

The photoreceptor 10 is a negatively charged photoreceptor, which turns in the arrow-marked direction in the drawing. A phthalocyanine based photoreceptor can be used as a negatively charged photoreceptor.

The charging unit 11 allows the surface of the photoreceptor 10 to be negatively charged. A charging unit such as a scorotron charging unit and roller charging unit can be used. A surface potential sensor 31 is used for charged potential control. When the output value of the surface potential sensor 31 is fed back to the output of the charging unit 11, the charged potential can be placed under control.

In response to the image data, the exposure unit 12 exposes imagewise the photoreceptor 10 negatively charged by the charging unit 11 so that a latent image is formed on the surface of the photoreceptor 10. A semiconductor laser and LED (Light Emitting Diode) array can be used as a light source of the exposure unit 12.

The developing device 13 of the present embodiment will be described in the case of using a two-component developing device is used. It is to be understood, however, that the one-component developing device can be used. A developer mainly composed of toner and carrier is incorporated in the casing 130. The toner is negatively charged toner negatively charged by triboelectric charging with the carrier.

A development sleeve 131 carries a developer D and turns in the arrow-marked direction of the drawing (moves in the direction opposite the photoreceptor traveling direction at the position opposed to the photoreceptor). This allows the developer D to be supplied to the portion opposed to the photoreceptor 10. A magnet roll 132 for retaining the developer on the development sleeve by magnetic force is fixed inside the development sleeve 131. A regulating blade 133 for regulating the amount of developer on the development sleeve 131 is arranged inside the casing 130 at the position opposed to the development sleeve 131. A paddle roller 134 for supplying a developer to the development sleeve 131 is provided upstream of the regulating blade 133 in the rotating direction of the development sleeve 131, opposed to the development sleeve 131. The conveyance screws 135 and 136 are arranged on the side opposed to the development sleeve 131 through the paddle roller 134. These screws are used to circulate, mix and stir the developer inside the casing 130.

In the developer having been circulated, mixed and stirred by the conveyance screws 135 and 136, toner is negatively charged and the carrier is positively charged by triboelectric charging between toner and carrier. The charged developer is supplied to development sleeve 131 through the paddle roller 134. The height of the developer having been supplied to the development sleeve 131 is regulated by the regulating blade 133, and is supplied to the portion opposite to the photoreceptor 10.

The development bias Vb for controlling the amount of toner adhered to the photoreceptor 10 is applied to the development sleeve 131. The development bias Vb of the present embodiment will be explained using an example of a development bias wherein DC component Vb (DC) and AC component Vb (AC) are superimposed. The development bias made up of a DC component alone can also be utilized.

Figure 3:
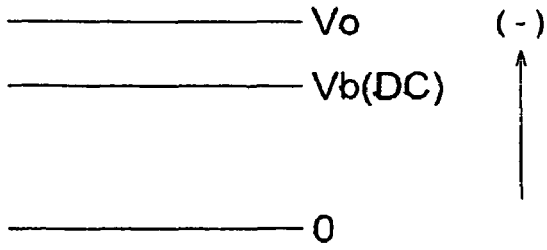
FIGS. 3(*a*) and 3(*b*) are transition diagrams representing the relationship between the photoreceptor potential and development bias potential in an image formation process.
Figure 3:
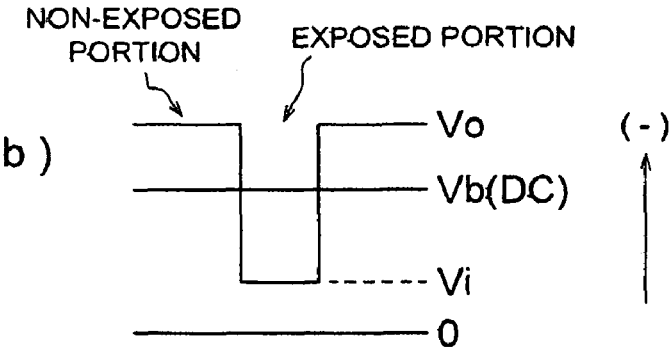
Figure 3:
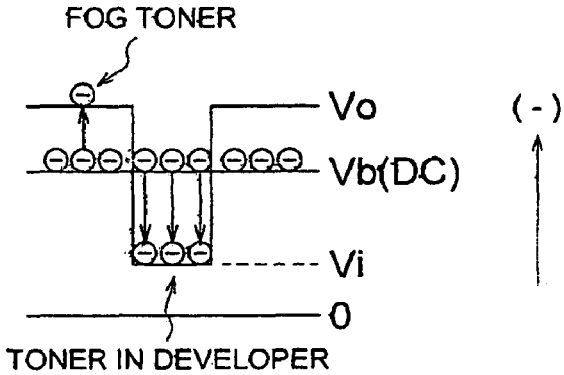

FIGS. 3(*a*) through 3(*c*) are transition diagrams representing the relationship between the photoreceptor potential and development bias potential in an image forming process. Firstly, the surface of the photoreceptor 10 is negatively and uniformly charged by the charging unit 11. In this case, the reading of the surface potential sensor 31 is fed back to the charging unit 11 and the photoreceptor 10 is charged to a predetermined charged potential (V0) (FIG. 3(*a*)).

The surface of the photoreceptor 10 charged to have a predetermined negative potential is exposed imagewise by the exposure unit 12 based on the image data. This procedure reduces the absolute value of the negative potential of the exposed portion (Vi), so that an electrostatic latent image is formed (FIG. 3(*b*)).

The surface of the photoreceptor 10 with an electrostatic latent image formed thereon reaches the portion opposed to the development sleeve 131, where development is carried out. The development bias Vb is applied to the development sleeve 131, and toner in the developer adheres to the portion exposed imagewise by an exposure unit 12. Further, if the difference between the surface potential V0 and potential of the development bias Vb (DC) is not sufficiently great, fog toner will adhere to the non-exposed portion (FIG. 3(*c*)).

(Fog Control)

Figure 4:
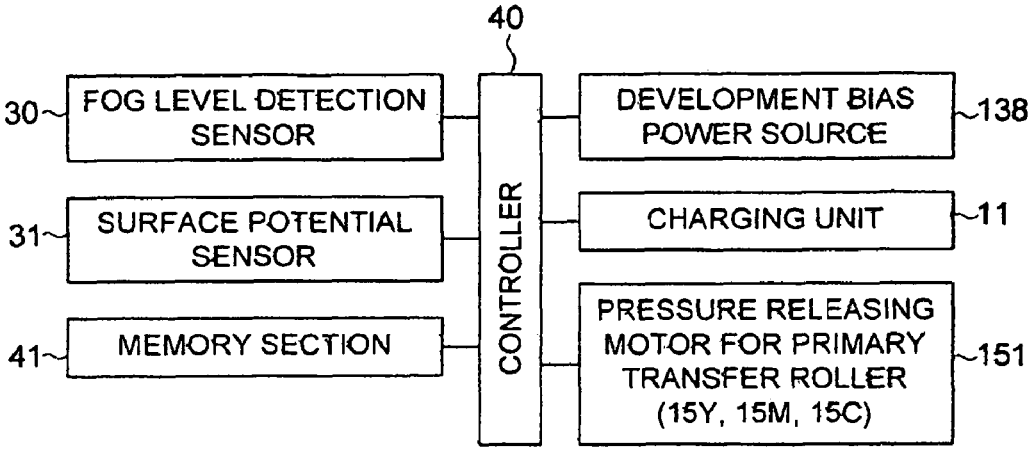
FIG. 4 is a block diagram representing the fog control configuration in the present embodiment.

FIG. 4 is a block diagram representing a fog control structure of the present embodiment. It shows only the control structure related to fog control, other control structures being omitted. It is mainly formed of many components including a controller 40 (fog controller) to provide fog control according to the program.

In addition to the fog control program for the fog control, the memory section 41 stores the target fog level and so on, which will be explained later. The fog detection level sensor 30 is a reflection type optical sensor. It inputs the output value corresponding to fog levels on the intermediate transfer member 20 onto the controller 40. The surface potential sensor 31 detects the surface potential of the photoreceptor 10 and inputs the output value into the controller 40.

The development bias power source 138 is a power source to apply development bias Vb to the development sleeve 131. Under fog control, the controller 40 provides control in such a way as to output the development bias Vb determined by the output value of the fog level detection sensor 30. In the present embodiment, the development bias Vb contains the DC component Vb (DC) and AC component Vb (AC) superimposed thereon. The Vb (DC) value, Vb (AC) peak-to-peak value and Vb (AC) frequency can be controlled by the controller 40.

Under fog control, the charging unit 11 is controlled by the controller 40 so as to provide the charged output determined according to the output value of the fog level detection sensor 30. In this case, the controller 40 adjusts the charged output value based on the output value of the surface potential sensor 31.

The pressure release motor 151 of the primary transfer rollers (15Y, 15M and 15C) is a motor to switch the contact pressure of the primary transfer rollers 15Y, 15M and 15C between the full color mode and the monochrome mode. Under the full color mode, the primary transfer rollers 15Y, 15M and 15C are switched over to the state of contact pressure by the controller 40. Under the monochrome mode, the primary transfer rollers 15Y, 15M and 15C are switched over to the released state by the controller 40.

<Fog Control Parameter>

Figure 5:
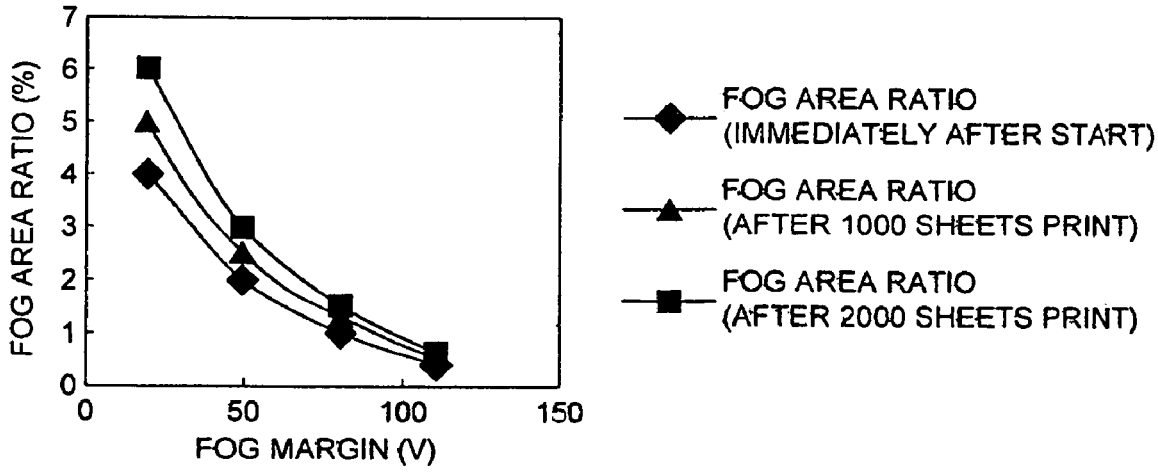
FIG. 5 is a characteristic diagram showing the relationship between the fog margin and fog area ratio in the full color mode in the present embodiment.

FIG. 5 is a characteristic diagram showing the relationship between the fog margin and fog area ratio in the full color mode in the present embodiment. Needless to say, this characteristic diagram is strictly an example, and the absolute value varies according to the apparatus configuration and environmental conditions. The fog margin can be defined as the absolute value of the difference between the surface potential V0 of the photoreceptor and the DC component Vb (DC) of development bias (FIG. 3(*c*)). The fog area ratio can be defined as the proportion of the toner deposited area (fog toner of four colors Y, M, C and K are deposited in the case of full color mode) with respect to the background portion of a predetermined area (surface of the intermediate transfer member 20 in the present embodiment).

FIG. 5 shows the characteristic curves wherein the fog margin (V) is plotted on the horizontal axis, and the fog area ratio (%) is plotted on the vertical axis in the phase of initial printing, and at the time of printing 1,000 sheets and 2,000 sheets. When the fog margin is constant, the fog area ratio is increased with the number of sheets to be printed, and the fog deterioration progresses.

When printed in the full color mode, the user cannot recognize as such, if the fog area ratio does not exceed about 2%. Accordingly, if the fog area ratio can be kept at 2% or less, quality problem does not arise with the passage of time. If the fog margin is 50 V in the phase of initial printing, 60 V at the time of printing 1,000 sheets, and 70 V at the time of printing 2,000 sheets, then the fog area ratio is kept at 2% or less, and no quality problem occurs.

The fog area ratio can be reduced below 2% by increasing the fog margin. However, this reduces the proportion of the fog toner discharged from the development apparatus, and the corresponding amount of fog toner will be stored in the development apparatus. This will result in quick deterioration of the fogging level when printing a large number of sheets. Thus, the fog area ratio is preferably kept at the upper limit (about 2%) wherein the user cannot identity the fog.

In the monochromatic mode, the relationship between the fog margin and fog area ratio exhibits the same characteristics as those in the full color mode, although this is not illustrated. The fog area ratio in the monochromatic mode wherein the fog cannot be identified by the user is lower than that in the full color mode and is about 1% or less, because fog toner is made up of only a black color (where the Y, M and C photoreceptors are apart from the intermediate transfer member) and is conspicuous. If the fog area ratio can be kept 1% or less chronologically, there is no quality problem. Thus, similarly to the case of full color mode, the fog area ratio is preferably maintained at the upper limit (about 1%) wherein the fog cannot be identified by the user.

The output value (target fogging level) of the fogging level detection sensor 30 corresponding to the target fog area ratio to be maintained in each of the full color mode and monochromatic mode is stored in the memory section 41 in advance. To ensure that the output value of the fogging level detection sensor 30 will reach the target fogging level, the DC component Vb (DC) of the surface potential V0 or development bias is controlled and the fog margin is adjusted, whereby the fogging level can be maintained in a proper state.

The fog control parameters include the peak-to-peak value and frequency of the Vb (AC) in addition to the surface potential V0 for adjusting the aforementioned fog margin, and the DC component Vb (DC) of the development bias. It goes without saying that a combination of these parameters can also be used a fog control parameter.

Generally, reduction of the peak-to-peak value of the Vb (AC) tends to reduce the fog area ratio, and increase of the frequency of the Vb (AC) tends to decrease the fog area ratio. This may differ according to the development system in some cases.

<Overview of Fog Control>

Figure 6:
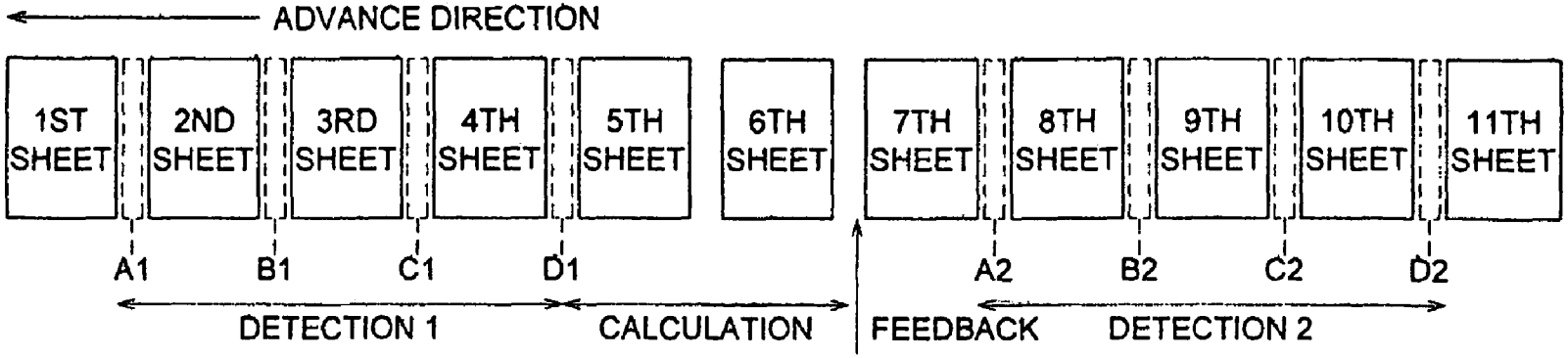
FIG. 6 is a general view showing the fog control in the present embodiment.

FIG. 6 is a general view showing the fog control in the present embodiment. This is only an example without the present invention being restricted thereto. As shown in FIG. 6, at the time of image formation, the toner image corresponding to the image for each sheet is formed on the intermediate transfer member 20. At the same time, a series of detection patterns are formed between toner images. Such series of detection patterns are formed during a job. In the example of FIG. 6, a detection pattern A1 is formed between the first and second images, a detection pattern B1 is formed between the second and third images, a detection pattern C1 is formed between the third and fourth images, and a detection pattern D1 is formed between the fourth and fifth images.

A series of detection patterns A1, B1, C1 and D1 having different fog area ratios can be obtained by forming a series of detection patterns A1, B1, C1, D1 after making fog control parameter values different from one another. The detection pattern A1, B1, C1 and D1 having been formed are detected by the fogging level detection sensor 30, whereby the output values a1, b1, c1 and d1 of fogging level detection sensor 30 corresponding to respective detection patterns are obtained.

The relational expression between the fog control parameter values and output value of the fogging level detection sensor 30 can be calculated from the obtained output values a1, b1, c1 and d1 of the fogging level detection sensor 30, and the fog control parameter values for respective output values. When the target fogging level stored in the memory section 41 in advance is applied to this relational expression, it is possible to get the target fog control parameter value required to obtain the target fogging level.

The obtained target fog control parameter value is used as a new target fog control parameter value for image formation. For the image of the page for which image formation has already started, image formation is performed using the same fog control parameter value as that prior to application. The new target fog control parameter value is applied, starting from the image on the page wherein new image formation is performed. In the example given in FIG. 6, application of a new target fog control parameter value starts from the image on the seventh sheet.

In the example given in FIG. 6, a detection pattern A2 is formed between the seventh and eighth images, a detection pattern B2 between the eighth and ninth images, a detection pattern C2 between the ninth and tenth images, and a detection pattern D2 between the tenth and eleventh images. Then the aforementioned control is repeated.

<Fog Control Flow>

Figure 7:
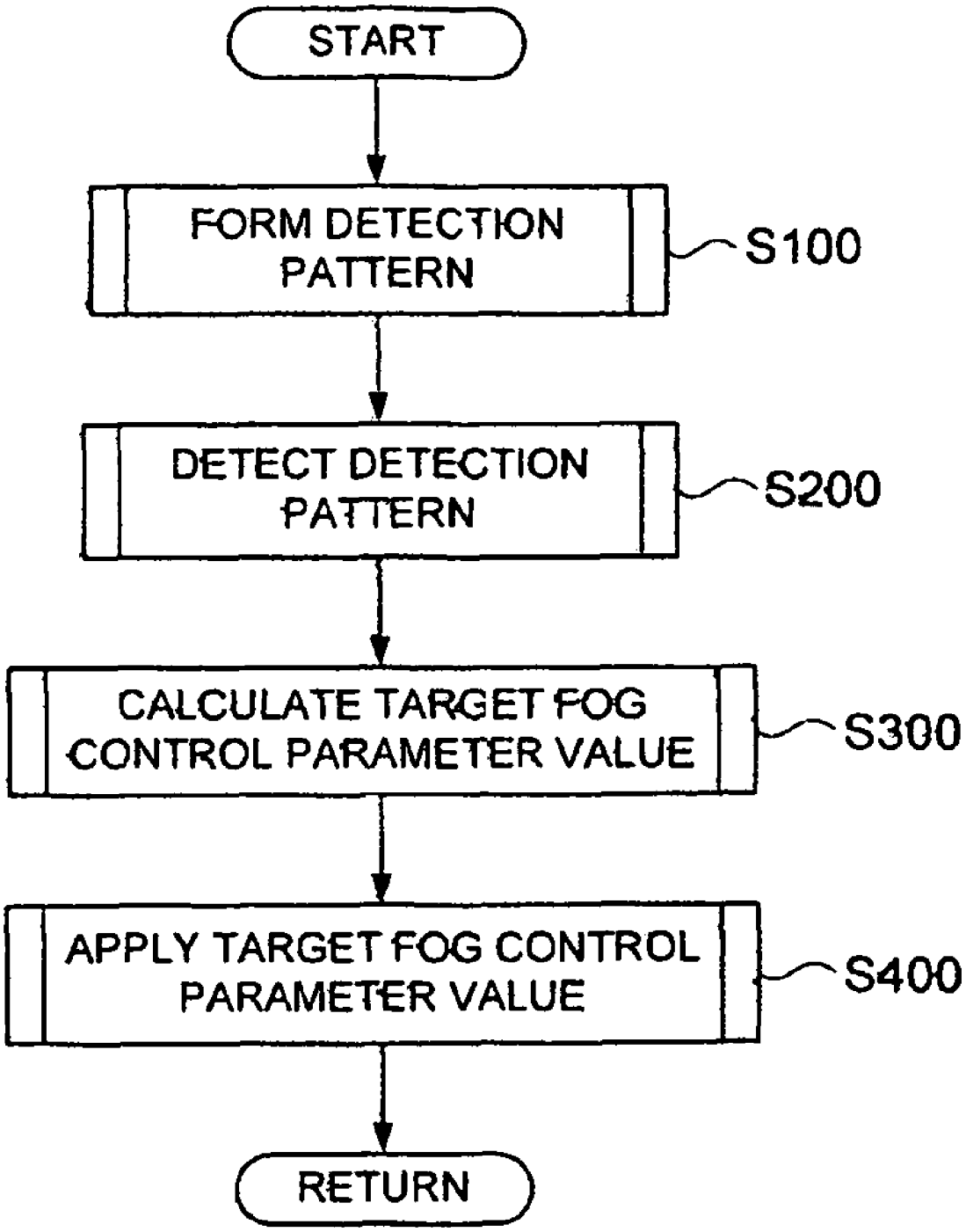
FIG. 7 is a flow diagram for fog control in the present embodiment.

FIG. 7 is a flow diagram for fog control in the present embodiment. The major steps include a detection pattern forming step (Step S100), a detection pattern detecting step (Step S200), target fog control parameter value calculating step (Step S300), and target fog control parameter value application step (Step S400). The following describes the details of these steps.

The following describes an example of changing the fog margin using the surface potential V0 of the photoreceptor as a fog control parameter. The fog margin can be changed using the DC component Vb (DC) of the development bias as a fog control parameter. Needless to say, the peak-to-peak value of the Vb (AC) and the frequency of Vb (AC) can also be used as the fog control parameter.

To facilitate understanding, it is assumed that, in each of the image forming sections Y, M, C and K, the surface potential V0 of the photoreceptor is set to −650 V, and the DC component Vb (DC) of the development bias is set to −600 V, for example (|−650 V−(−600V)|=50 V for fog margin), and formation of the page image is carried out in the full color mode. The values of the surface potential V0 and development bias Vb (DC) are only examples, without the present invention being restricted thereto.

Figure 8:
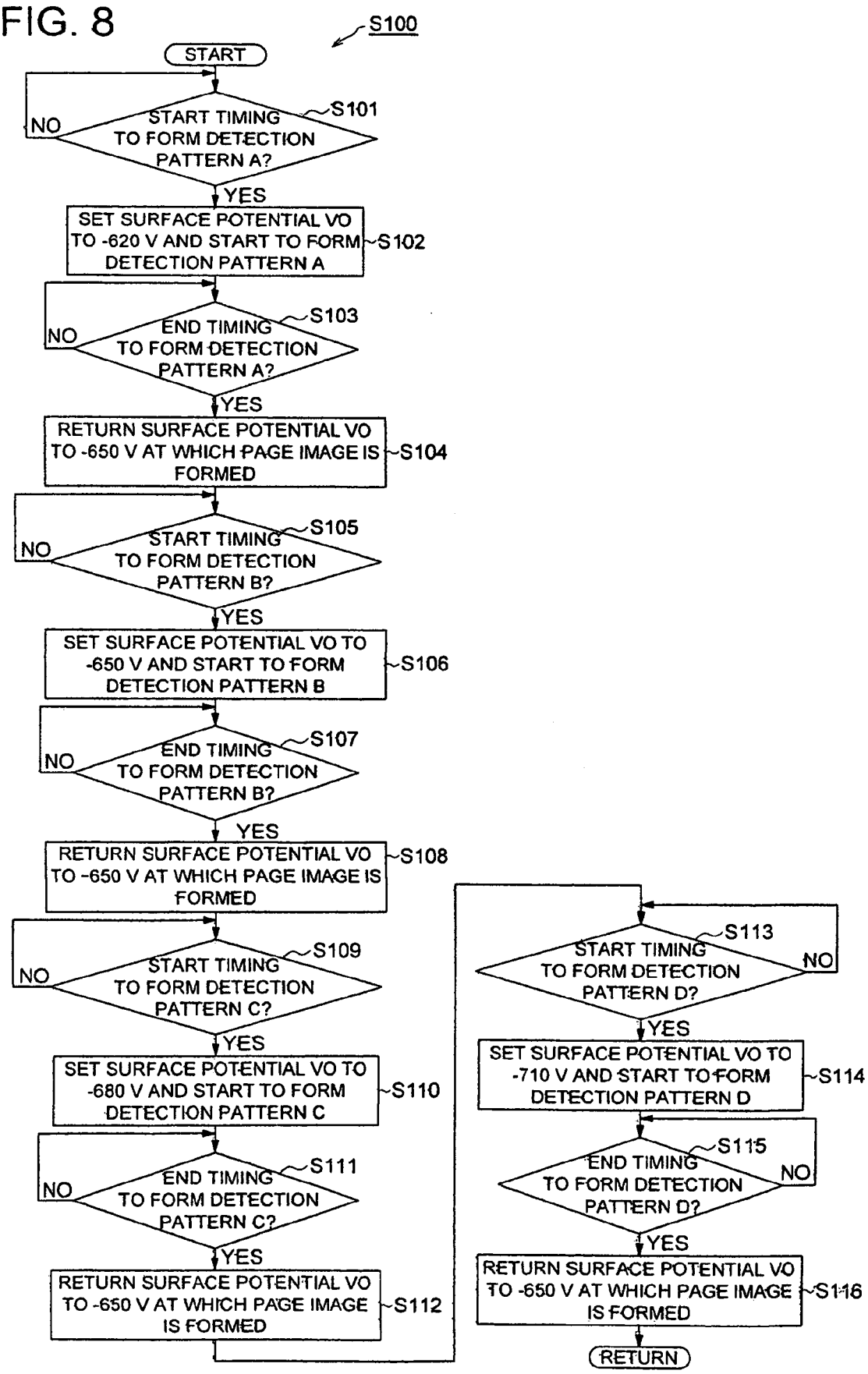
FIG. 8 is a control flow diagram for formation of a detection pattern in FIG. 7.

FIG. 8 is a control flow diagram for formation of a detection pattern shown in Step S100. The controller 40 determines whether or not a detection pattern A (corresponding to the patter of A1 or A2 in FIG. 6) should be formed on the photoreceptor 10 in each image forming section (Step S101). The detection pattern is to be formed when the detection pattern is formed between toner images for each page on the intermediate transfer member 20.

If it has determined that the detection pattern A should be formed on the photoreceptor 10 in each image forming section (Step S101: Yes), the controller 40 sets the surface potential V0, for example, to −620 V, and starts formation of the detection pattern A (Step S102) when the fog margin=|−620 V−(−600 V)|=20 V. The surface potential V0=−620 V for formation of this detection pattern A is stored in the memory section 41 in advance. Alternatively, this voltage can be determined by changing, for example, 30V with reference to the surface potential V0=−650 V for formation of the page image.

If it has determined that the detection pattern A should not be formed on the photoreceptor 10 in each image forming section (during page image) (Step S101: No), the controller 40 maintains the surface potential V0=−650 V for formation of page image in each image forming section until the time comes when the detection pattern A is to be formed on the photoreceptor 10.

In Step S103, the controller 40 determines whether or not formation of the detection pattern A on the photoreceptor 10 should be terminated in each image forming section. Formation of the detection pattern should be terminated from the time when the detection pattern has been formed in a size sufficient for detection by the fogging level detection sensor 30, up to the time when the formation of the next page image starts.

If it has determined that the formation of the detection pattern A on the photoreceptor 10 should be terminated in each image forming section (Step S103: Yes), the controller 40 returns the surface potential V0 to −650 V for page image formation so as to provide for the formation of the next page image (Step S104).

If it has determined that the formation of the detection pattern A on the photoreceptor 10 should not be terminated in each image forming section (during formation of the detection pattern A) (Step S103: No), the controller 40 maintains the surface potential V0=−620 V for formation of the detection pattern A in each image forming section until the time comes when formation of the detection pattern A on the photoreceptor 10 is to be terminated.

In Step S105, the controller 40 determines-whether or not a detection pattern B (corresponding to B1 or B2 in FIG. 6) should be formed on the photoreceptor 10 in each image forming section.

If it has determined that a detection pattern B should be formed on the photoreceptor 10 in each image forming section (Step S105: Yes), the controller 40 sets the surface potential V0, for example, to −650 V (a value obtained by adding −30V to the surface potential −620 V having been set at the time of forming the detection pattern A). Then formation of the detection pattern B starts when the fog margin=|−650 V−(−600 V)|=50 V (Step S106).

If it has determined that a detection pattern B should not be formed on the photoreceptor 10 in each image forming section (during formation of page image) (Step S105: No), the controller 40 maintains the surface potential V0=−650 V for forming the page image, until the time comes when the detection pattern B is to be formed on the photoreceptor 10 in each image forming section.

In Step S107, the controller 40 determines whether or not formation of the detection pattern B on the photoreceptor 10 should be terminated in each image forming section.

If it has determined that formation of the detection pattern B on the photoreceptor 10 should be terminated in each image forming section (Step S107: Yes), the controller 40 returns the surface potential V0 to −650 V for page image formation so as to provide for the formation of the next page image (Step S108).

If it has determined that formation of the detection pattern B on the photoreceptor 10 should not be terminated in each image forming section (during formation of the detection pattern B) (Step S107: No), the controller 40 maintains the surface potential V0=−650 V for formation of the detection pattern B until the times comes when formation of the detection pattern B on the photoreceptor 10 should be terminated in each image forming section.

In the Step S109, the controller 40 determines whether or not a detection pattern C (corresponding to C1 or C2 in FIG. 6) should be formed on the photoreceptor 10 in each image forming section.

If it has determined that a detection pattern C should be formed on the photoreceptor 10 in each image forming section (Step S109: Yes), the controller 40 sets the surface potential V0, for example, to −680 V (a value obtained by adding −60V to the surface potential −620 V having been set at the time of forming the detection pattern A). Then formation of the detection pattern C starts when the fog margin=|−680 V−(−600 V)|=80 V (Step S110).

If it has determined that a detection pattern C should not be formed on the photoreceptor 10 in each image forming section (during formation of page image) (Step S109: No), the controller 40 maintains the surface potential V0=−650 V for forming the page image, until the time comes when the detection pattern C is to be formed on the photoreceptor 10 in each image forming section.

In Step S111, the controller 40 determines whether or not formation of the detection pattern C on the photoreceptor 10 should be terminated in each image forming section.

If it has determined that formation of the detection pattern C on the photoreceptor 10 should be terminated in each image forming section (Step S111: Yes), the controller 40 returns the surface potential V0 to −650 V for page image formation so as to provide for the formation of the next page image (Step S112).

If it has determined that a detection pattern C should not be formed on the photoreceptor 10 in each image forming section (during formation of detection pattern C) (Step S111: No), the controller 40 maintains the surface potential V0=−680 V for forming the detection pattern C, until the time comes when the formation of the detection pattern C is to be terminated on the photoreceptor 10 in each image forming section.

In the Step S113, the controller 40 determines whether or not a detection pattern D (corresponding to D1 or D2 in FIG. 6) should be formed on the photoreceptor 10 in each image forming section.

If it has determined that a detection pattern D should be formed on the photoreceptor 10 in each image forming section (Step S113: Yes), the controller 40 sets the surface potential V0, for example, to −710 V (a value obtained by adding −90V to the surface potential −620 V having been set at the time of forming the detection pattern A). Then formation of the detection pattern D starts when the fog margin=|−710 V−(−600 V)|=110 V (Step S114).

If it has determined that a detection pattern D should not be formed on the photoreceptor 10 in each image forming section (during formation of page image) (Step S113: No), the controller 40 maintains the surface potential V0=−650 V for forming the page image, until the time comes when the detection pattern D is to be formed on the photoreceptor 10 in each image forming section.

In Step S115, the controller 40 determines whether or not formation of the detection pattern D on the photoreceptor 10 should be terminated in each image forming section.

If it has determined that formation of the detection pattern D on the photoreceptor 10 should be terminated in each image forming section (Step S115: Yes), the controller 40 returns the surface potential V0 to −650 V for page image formation so as to provide for the formation of the next page image (Step S116).

If it has determined that a detection pattern D should not be formed on the photoreceptor 10 in each image forming section (during formation of detection pattern D) (Step S115: No), the controller 40 maintains the surface potential V0=−710 V for forming the detection pattern D, until the time comes when the formation of the detection pattern D is to be terminated on the photoreceptor 10 in each image forming section.

In the present embodiment, four detection patterns A, B, C and D have been formed by using different surface potentials V0, without the present invention being restricted to four patterns. Any number of detection patterns can be formed if it is more than one.

Figure 9:
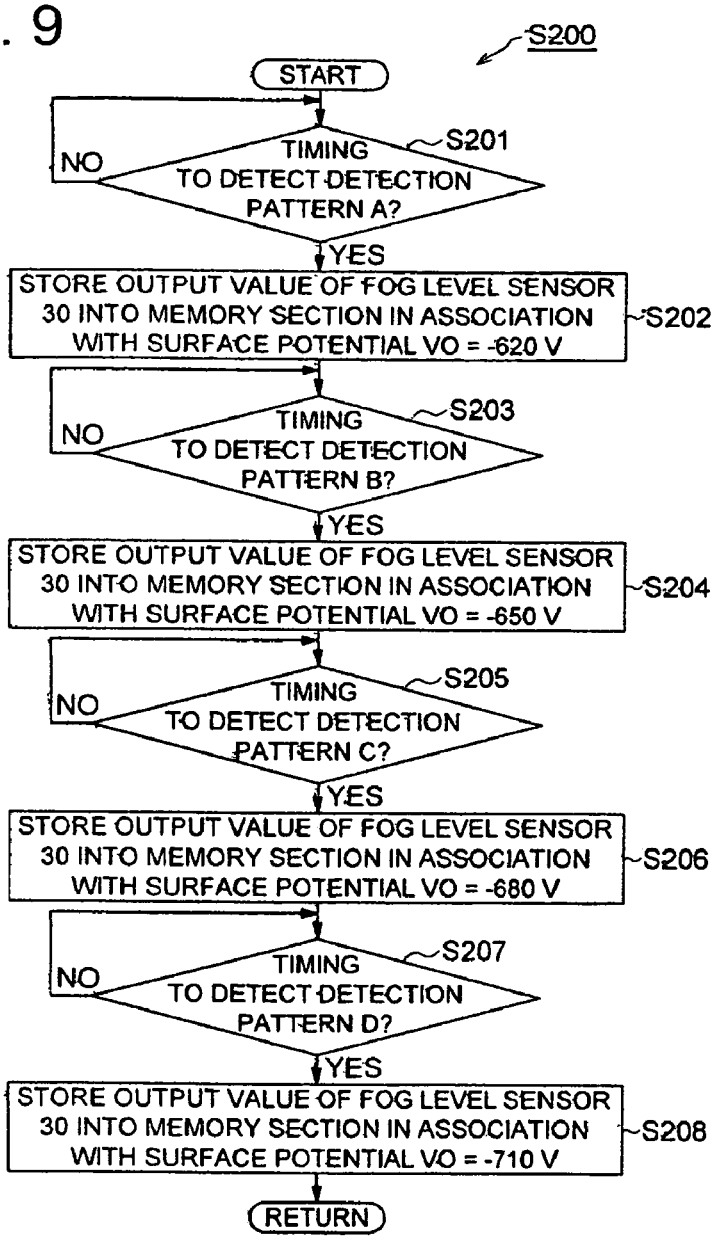
FIG. 9 is a control flow diagram for detecting the detection pattern in FIG. 7.

FIG. 9 is a control flow diagram for detecting the detection pattern in Step S200. In the first place, the controller 40 determines whether or not detection pattern A should be detected (Step S201).

If it has determined that the detection pattern A on the photoreceptor 10 should be detected (Step S201: Yes), the controller 40 allows the output value of the fogging level detection sensor 30 to be stored into the memory section 41 (Step S202). In this case, the output value is stored in the form associated with the surface potential V0=−620 V for formation of the detection pattern A. If it has determined that the detection pattern A on the photoreceptor 10 should not be detected (Step S201: No), the controller 40 waits until the time comes when the detection pattern A is to be detected.

The controller 40 determines whether or not detection pattern B should be detected (Step S203). If it has determined that the detection pattern B on the photoreceptor 10 should be detected (Step S203: Yes), the controller 40 allows the output value of the fogging level detection sensor 30 to be stored into the memory section 41 (Step S204). In this case, the output value is stored in the form associated with the surface potential V0=−650 V for formation of the detection pattern B. If it has determined that the detection pattern B on the photoreceptor 10 should not be detected (Step S203: No), the controller 40 waits until the time comes when the detection pattern B is to be detected.

The controller 40 determines whether or not detection pattern C should be detected (Step S205). If it has determined that the detection pattern C on the photoreceptor 10 should be detected (Step S205: Yes), the controller 40 allows the output value of the fogging level detection sensor 30 to be stored into the memory section 41 (Step S206). In this case, the output value is stored in the form associated with the surface potential V0=−680 V for formation of the detection pattern C. If it has determined that the detection pattern C on the photoreceptor 10 should not be detected (Step S205: No), the controller 40 waits until the time comes when the detection pattern C is to be detected.

The controller 40 determines whether or not detection pattern D should be detected (Step S207). If it has determined that the detection pattern D on the photoreceptor 10 should be detected (Step S207: Yes), the controller 40 allows the output value of the fogging level detection sensor 30 to be stored into the memory section 41 (Step S208). In this case, the output value is stored in the form associated with the surface potential V0=−710 V for formation of the detection pattern D. If it has determined that the detection pattern D on the photoreceptor 10 should not be detected (Step S207: No), the controller 40 waits until the time comes when the detection pattern D is to be detected.

Figure 10:
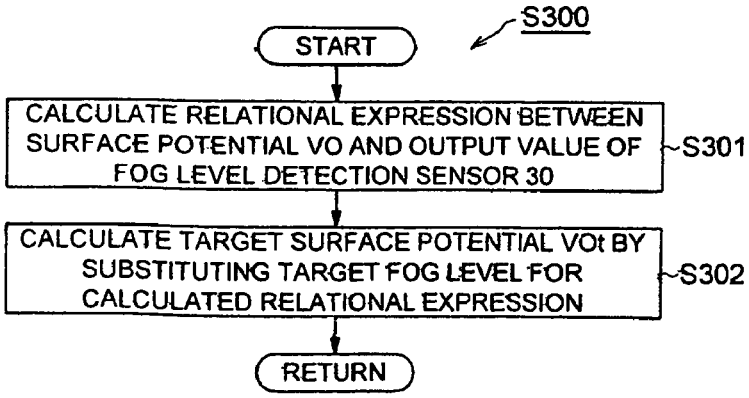
FIG. 10 is a control flow diagram for calculating the target fog control parameter value in FIG. 7.

FIG. 10 is a control flow diagram for calculating the target fog control parameter value in Step S300. In the present embodiment, the surface potential V0 is used as a fog control parameter, and therefore, the target surface potential $V0_t$ is calculated.

The controller 40 calculates the relational expression between the surface potential V0 and output value of the fogging level detection sensor 30, based on each output value when the detection patterns A, B, C and D has been detected by the fogging level detection sensor 30, and the value of the surface potential V0 associated with each output value, wherein the aforementioned detection patterns A, B, C and D are obtained in the detection step S200 of the detection pattern and are stored in the memory section 41. For example, the regression equation is obtained by approximation to the quadratic equation using the commonly known method of least square (Step S301).

Then the controller 40 substitutes into the aforementioned relational expression the target fogging level stored in the memory section 41 in advance, thereby calculating the target surface potential $V0_t$ (Step S302). In the present invention, the target fogging level stored in the memory section 41 in advance corresponds to the target fog area ratio 2% in the full color mode.

Association can be maintained by storing the target fog area ratio instead of storing the target fogging level. In this case, a table representing the relationship between the fog area ratio and the value of the fogging level detection sensor 30 must be stored.

Figure 11:
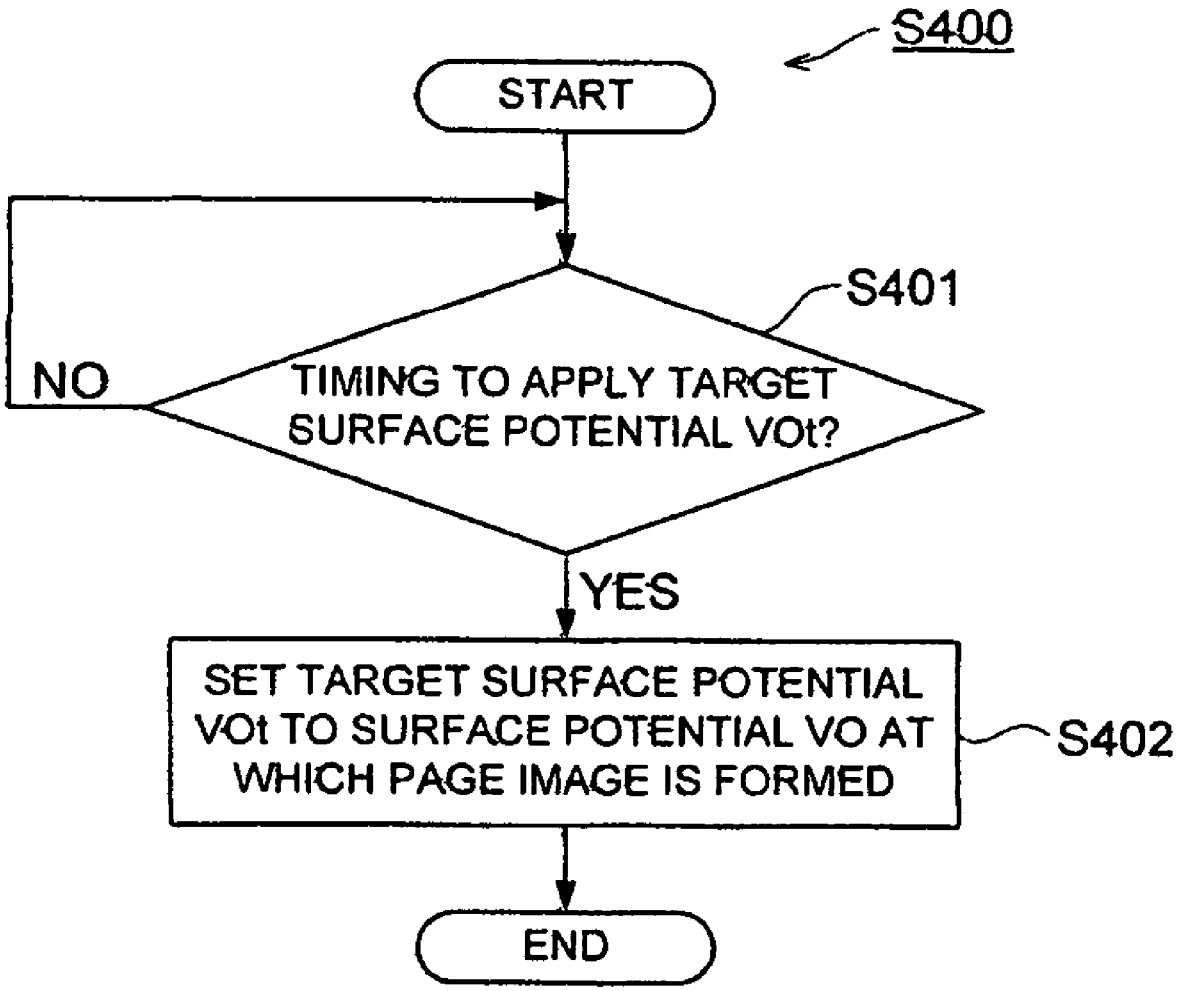
FIG. 11 is a control flow diagram for application of the target fog control parameter value in FIG. 7.

FIG. 11 is a control flow diagram for application of the target fog control parameter value in Step S400. In the present embodiment, surface potential V0 is used as the fog control parameter, and the target surface potential $V0_t$ calculated in Step S300 is applied.

In the first place, the controller 40 determines whether or not the target surface potential $V0_t$ should be applied (Step S401). If it has determined that the target surface potential $V0_t$ should be applied (Step S401: Yes), the controller sets the target surface potential $V0_t$ as the surface potential V0 for page image formation (Step S402). The application of target surface potential $V0_t$ starts from the page image for starting new image formation, subsequent to the calculation of the target surface potential $V0_t$. Thus, the value of the surface potential V0 for page image formation can be updated from the page image in the middle of the job. Fogging level variation is minimized, and fog deterioration is prevented even if the job requires a long time.

If it has determined that the target surface potential $V0_t$ should not be applied (Step S401: No), the controller 40 waits until the time comes when the target surface potential $V0_t$ is to be applied.

The fog control of the present embodiment has been described for the case where the present invention is applied to the full color mode. Needless to say, the present invention is also applicable to the monochromatic mode.

As described above, in the present invention, the fogging level is detected in the middle of the job, and feedback can be given to the fog control parameter in the middle of the job. This arrangement minimizes the fogging level variation and prevents fog deterioration to occur even in the job requiring a long time.

The fogging level is maintained at the fog area ratio of the upper limit where the fog cannot be identified by the user, and therefore, fog toner is discharged from the development apparatus to the image to the extent that fog toner cannot be identified. This prevents fog toner from depositing inside the development apparatus, and ensures an image of preferable fogging level over a long period of time.

In the present embodiment, fog control is provided by a fogging level detection sensor 30 arranged on the intermediate transfer member 20 for the purpose of downsizing and cost reduction. It is also possible to arrange such a configuration that a fogging level detection sensor is provided between the development apparatus 13 on each the photoreceptor 10 and the primary transfer roller 15, and fog control is provided independently.

In the present embodiment, the present invention is applied to the image forming apparatus in the tandem full color mode. The present invention can also be applied to the image forming apparatus in the monochromatic mode. In this case, a fogging level detection sensor is provided between the development apparatus on the photoreceptor and transfer apparatus, and fog control is provided wherein the target fogging level corresponding to the target fog area ratio of 1% is assumed as a target.

What is claimed is:

1. An image forming apparatus comprising:

(a) a toner image carrier configured to carry a plurality of toner images;

(b) a detection pattern forming section configured to form a series of detection patterns on the toner image carrier, each detection pattern formed between toner images on the toner image carrier;

(c) a fogging level detection section provided opposite to the toner image carrier and configured to detect a fogging level associated with each detection pattern formed by the detection pattern forming section;

(d) a memory section configured to store a target fogging level representing an upper limit of a fog area ratio of a detection pattern; and (e) a fog controller configured to adjust a fog control parameter that defines a discharge of a fog toner from a developing device onto a toner image, based on the fogging levels detected by the fogging level detection section and the target fogging level stored in the memory section, wherein the fog controller is further configured to control a fogging level below the upper limit of the fog area ratio by applying the fog control parameter to the image forming apparatus, so as to discharge fog toner from the developing device onto the toner image carrier having the plurality of toner images.

2. The image forming apparatus of claim 1, wherein the toner image carrier is an intermediate transfer member, and the image forming apparatus further comprises a plurality of image forming sections, each having:

(1) an electrostatic latent image carrier provided opposite to the intermediate transfer member, (2) a charging unit which charges a surface of the electrostatic latent image carrier, (3) an exposure unit which exposes the surface of the electrostatic latent image carrier charged by the charging unit to form an electrostatic latent image on the surface of the electrostatic latent image carrier, and (4) a developing device which develops the electrostatic latent image by a developer bearing member that holds a toner thereon to form a toner image on the surface of the electrostatic latent image carrier; and a plurality of transfer units, each provided opposite to each of the plurality of image forming sections and configured to transfer the toner image that has been formed on the surface of the electrostatic latent image carrier onto a surface of the intermediate transfer member.

3. The image forming apparatus of claim 1, wherein the toner image carrier is an electrostatic latent image carrier, the image forming apparatus further comprising:

a charging unit configured to charge a surface of the electrostatic latent image carrier, an exposure unit configured to expose the surface of the electrostatic latent image carrier charged by the charging unit to form an electrostatic latent image on the surface of the electrostatic latent image carrier, and a developing device configured to develop the electrostatic latent image by a developer bearing member that holds a toner thereon.

4. The image forming apparatus of claim 2, wherein the fog control parameter corresponds to a surface potential of the electrostatic latent image carrier charged by the charging unit.

5. The image forming apparatus of claim 3, wherein the fog control parameter corresponds to a surface potential of the electrostatic latent image carrier charged by the charging unit.

6. The image forming apparatus of claim 1, wherein the image forming apparatus comprises a developing device configured to develop an electrostatic latent image by a developer bearing member that holds a toner to form a toner image, and the fog control parameter corresponds to a developing bias voltage to apply to the developer bearing member.

7. The image forming apparatus of claim 6, wherein the developing bias voltage has an alternate current component, and the fog control parameter corresponds to a peak-to-peak voltage of the alternate current component.

8. The image forming apparatus of claim 6, wherein the developing bias voltage has an alternate current component, and the fog control parameter corresponds to frequency of the alternate current component.

9. The image forming apparatus of claim 1, wherein the target fogging level is determined based on a target fog area ratio.

10. The image forming apparatus of claim 2, wherein the plurality of image forming sections comprises a yellow image forming section, a magenta image forming section, a cyan image forming section and a black image forming section, wherein the image forming apparatus has a monochromatic mode in which image formation is carried out using black image forming section only, and a full color mode in which the image formation is carried out using all of the yellow image forming section, the magenta image forming section, the cyan image forming section and the black image forming section, and wherein the target fogging level is determined based on a target fog area ratio, and a target fog area ratio associated with the monochromatic mode is different from a target fog area ratio associated with the full color mode.

11. The image forming apparatus of claim 9, wherein the target fog area ratio in the monochromatic mode is smaller than the target fog area ratio associated with the full color mode.

12. A method for controlling a fogging level of a toner image carrier of an image forming apparatus method comprising the steps of:

(a) storing in a memory section a target fogging level representing an upper limit of a fog area ratio;

(b) forming a series of detection patterns on the toner image carrier, each detection pattern formed between toner images carried on the toner image carrier;

(c) detecting a fogging level associated with each detection pattern of the series of detection patterns;

(d) adjusting a fog control parameter that defines a discharge of fog toner from a developing device to a toner image, based on each detected fogging level of the series of detection patterns and the target fogging level stored in the memory section; and (e) controlling a fogging level below the upper limit of the fog area ratio by applying the fog control parameter to the image forming apparatus, so as to discharge fog toner from the developing device to the toner image carrier having the toner images.

13. The method of claim 12, wherein the toner image carrier is an electrostatic latent image carrier and the fog control parameter corresponds to a surface potential of the electrostatic latent image carrier charged by a charging unit.

14. The method of claim 12, wherein the image forming apparatus comprises a developing device configured to develop an electrostatic latent image by a developer bearing member that holds a toner thereon to form a toner image, and the fog control parameter corresponds to a developing bias voltage to apply to the developer bearing member.

15. The method of claim 14, wherein the developing bias voltage has an alternate current component, and the fog control parameter corresponds to a peak-to-peak voltage of the alternate current component.

16. The method of claim 14, wherein the developing bias voltage has an alternate current component, and the fog control parameter corresponds to frequency of the alternate current component.

* * * * *